US010822147B2

(12) United States Patent
Bongiovanni

(10) Patent No.: US 10,822,147 B2
(45) Date of Patent: Nov. 3, 2020

(54) COMBINATION CONTAINER AND FUNNEL HAVING FLEXIBLE POURING SPOUT

(71) Applicant: John Bongiovanni, New Hyde Park, NY (US)

(72) Inventor: John Bongiovanni, New Hyde Park, NY (US)

( * ) Notice: Subject to any disclaimer, the term of this patent is extended or adjusted under 35 U.S.C. 154(b) by 319 days.

(21) Appl. No.: 15/610,932

(22) Filed: Jun. 1, 2017

(65) Prior Publication Data

US 2018/0346209 A1 Dec. 6, 2018

(51) Int. Cl.
*B65D 47/06* (2006.01)
*B65D 47/12* (2006.01)

(52) U.S. Cl.
CPC ..... *B65D 47/063* (2013.01); *B65D 47/122* (2013.01)

(58) Field of Classification Search
CPC ..... B65D 47/063; B65D 47/122
USPC ... 222/86, 87, 527, 529, 531, 533, 566, 572; 141/331, 337, 342
See application file for complete search history.

(56) References Cited

U.S. PATENT DOCUMENTS 3,490,501 A * 1/1970 Lefebvre ..... G01F 19/00 141/331
3,874,429 A 4/1975 Lafarge
4,267,945 A * 5/1981 Maynard, Jr. ..... B67C 11/02 141/327
4,600,042 A 7/1986 York et al.
4,602,728 A * 7/1986 Ha ..... B65D 25/44 222/528
4,789,017 A * 12/1988 Panasewicz ..... B67B 7/28 141/311 R
5,080,149 A 1/1992 Peoples
5,133,481 A * 7/1992 Mayfield ..... B65D 25/44 141/299
5,488,979 A * 2/1996 McKenzie ..... B65B 39/00 141/311 A
5,503,308 A * 4/1996 Young ..... B65D 1/023 222/529
5,722,570 A 3/1998 Sultzer, III et al.
5,975,380 A * 11/1999 West, Jr. ..... B65D 41/04 222/529
D559,048 S * 1/2008 McKenzie ..... D15/150
20,085,793 4/2012 Selina
8,790,110 B2 * 7/2014 Grimes ..... B29C 47/12 222/206
2004/0188474 A1 9/2004 Johnston
(Continued)

OTHER PUBLICATIONS

Screen captures from YouTube video clip entitled "4 Ways to Make an Engine Oil Funnel & 2 Ways to Pour Oul", 3 pages, Uploaded on May 26, 2014 by user "Genius Asian". Retrieved from Internet: <https://www.youtube.com/watch?v=ICcqwXPSxmk>.*

*Primary Examiner* — Vishal Pancholi
(74) *Attorney, Agent, or Firm* — Peter A. Hurley

(57) ABSTRACT

A device for acting as both a container and a funnel which has a body, a neck, a spout, and a base. The base is for being at least partially detached from the body after the dispensing of the fluid through the spout via the neck, so that the body, the neck, and the spout may act as a funnel. The base has an indented portion and a flush portion. The base 18 has at least two guides. The guides are for guiding a user in cutting of the device. When a user cuts along the upper guide the lower guide, a bottom portion and a central portion are separated from the base. The bottom portion may act as a cover for the device.

2 Claims, 7 Drawing Sheets

(56) References Cited

U.S. PATENT DOCUMENTS

| | | | | |
|---|---|---|---|---|
| 2006/0243756 | A1 | 11/2006 | Kawakita | |
| 2009/0272760 | A1 | 11/2009 | Ugone | |
| 2010/0044339 | A1* | 2/2010 | Rogers Martijena | B65D 1/0223 215/371 |
| 2010/0163641 | A1 | 7/2010 | Ugone | |

* cited by examiner

COMBINATION CONTAINER AND FUNNEL HAVING FLEXIBLE POURING SPOUT

BACKGROUND OF THE INVENTION

Field of the Invention

The present invention relates to a multi-use container, and more particularly, a COMBINATION CONTAINER AND FUNNEL HAVING FLEXIBLE POURING SPOUT.

Description of the Prior Art

Numerous innovations for multi-use containers have been provided in the prior art that will be described. Even though these innovations may be suitable for the specific individual purposes to which they address, however, they differ from the present invention.

A FIRST EXAMPLE, U.S. Pat. No. 3,874,429, Published/Issued on Apr. 1, 1975, to LaFarge teaches a combined funnel and container device comprising first and second hollow plastic bottles, each bottle having a reduced diameter open neck with external threads at one end. The other end of one bottle is cut away. The other bottle is disposed in vertical upright position. The one bottle is disposed in vertical inverted position with its vertical neck extending above and abutting the upright neck of said other bottle. A manually operable connector sleeve detachably secures the abutting necks together in a leak proof meanner. The inverted bottle functions as a funnel to conduct liquid into the upright bottle. The inverted bottle can then be removed and the upright bottle capped.

A SECOND EXAMPLE, U.S. Pat. No. 4,600,042, Published/Issued on Jul. 15, 1986, to York, et al. teaches an oil dispensing and receiving apparatus that attaches to the oil inlet of a gas combustion engine to open and transfer oil from quart cans or plastic bottles into the engine crankcase without the use of a funnel or other device, and which remains on the engine and replaces the oil cap. The apparatus is equipped with a hinged lid which may be sealed tightly, vented with an air vent cap or adopted to receive a vacuum line for ventilation of the apparatus. The apparatus is fastened into the oil inlet opening in a gas combustion engine by forcing a tapered wedge up into a tapered housing of the apparatus, expanding the sidewalls thereof outwardly to secure it to the oil inlet opening. The apparatus has a number of bushings of various sizes to fit most inlet openings. It also has a twist lock bushing that will lock into the oil inlet and the apparatus fits inside of the bushing and locks tightly to the inlet by tightening of a bolt that draws the tapered wedge up into the apparatus, expanding its sides. The apparatus is equipped with a cutter blade to pierce and open the cans or bottles, which then allows the oil to drain from the can or plastic bottle into the engine crankcase, and the cutter blade is attached to the apparatus and is held in place by the bolt running through the center of it, that screws into the tapered wedge. This apparatus is adaptable to almost any size or shape oil inlet opening through the use of various sized and shaped bushings and can be used to permanently replace a sealed oil cap, an air vent oil cap, or an oil cap equipped with a vacuum line.

A THIRD EXAMPLE, U.S. Pat. No. 5,080,149, Published/Issued on Jan. 14, 1992, to Peoples teaches a collapsible and disposable container for engine oil which can package fresh engine oil for dispensing into internal combustion engines, or alternatively can be employed for catching, holding and storing engine oil drained from an internal combustion engine when it is desired to change the oil.

A FOURTH EXAMPLE, U.S. Pat. No. 5,722,570, Published/Issued on Mar. 3, 1998, to Sultzer III, et al. teaches an extendible, retractable pouring spout is provided affixed to the upper portion of an enclosed container. The spout has a discharge orifice at its distal end and a discharge orifice sealing means, such as a cap. The pouring spout can be extended or retracted in an accordion type manner, in order to provide a directable, adjustable, funnel-like fluid discharge means from the container which can be directed into various directions and utilized in various orientations. The user is able to directionally pour the contents of the container with all the advantages of utilizing a funnel, without the necessity of utilizing an additional funnel.

A FIFTH EXAMPLE, U.S. Patent Office Document No. 20040188474, Published/Issued on Sep. 30, 2004, to Johnston teaches a Collapsible/Flexible Pouring Attachment that improves the safety and pouring of fluid from a plastic bottle and/or container. It enhances the overall packaging of automotive lubricants, household chemicals, agricultural products and the like by eliminating the burden of locating a funnel to aid in dispensing. It has a bellowed pour spout, which makes it collapsible, flexible, retractable, and expandable, as well as maintain its 'locked' position. It has a dual threaded base (internal and external) that enables it to attach to a cap and a bottleneck using a single point of connection. When the bellows are collapsed a cap can be screwed onto the external thread of the dual threaded base, such that the bellowed tubular spout is concealed and screwed in the cap's interior. This feature allows the cap and the bellowed tubular spout and the dual threaded base to be manipulated as a single unit. Assembled in this way, it can be fed into a capping machine and positioned and rotated like a standard cap. This is particularly beneficial in mass production. It does not interrupt the high volume and high speed mass production required to fill and cap bottles.

Another valuable feature of the Collapsible/Flexible Pouring Attachment is it mirrors the existing relationship, between a bottle and a cap, that consumers are accustom to encountering. There is little-to-no learning curve to utilize this package improvement. With its robust set of features the Collapsible/Flexible Pouring Attachment provides all of the benefits of a custom dispenser and circumvents all of the deficiencies of external dispensers. It is safer, more effective and convenient. It eliminates 'free-hand' pouring. It is always accessible because it is attached to the bottle/container. It is a pour spout, a closure and an intricate component of the packaging.

A SIXTH EXAMPLE, U.S. Patent Office Document No. 20060243756, Published/Issued on Nov. 2, 2006, to Kawakita teaches a gravity-fed liquid chemical dispenser bottle (100) with a broad representation of gravity feed features used for an extremely viscous chemical, which stops the irritating wait for a bottle turned upside down to dispense thick liquid chemical (204) such as condiments, pharmaceuticals, motor oil, etc especially with a low bottle, furthermore, many advantages accrue to this design including no human user flip container action leading to long impatient user waits and messy spills, very little chemical waste from side and bottom cling, no air dispensing and non-emulsified liquid dispensing, furthermore, the device consists of a glass or squeezable plastic bottle shaped like a prior art ketchup bottle having a twist ventilation only cap (102) on top of the bottle, a one-way trapdoor diaphragm (103) or one-way diaphragm mechanism to prevent spills and liquid chemical (204) dispensing from the top, a real bottle top with ventilation hole (104) with top-end neck, a liquid chemical bottle body (106) with bottom-end neck, a real bottle bottom with nozzle (108) or nozzle fitting, a flip-off/flip-on nozzle cap (110), and a false bottle bottom or stand (112) with an opposing end anti-drip cap.

A SEVENTH EXAMPLE, U.S. Patent Office Document No. 20090272760, Published/Issued on Nov. 5, 2009, to Ugone teaches a fluid containing and dispersing apparatus comprising, in one embodiment, a primary fluid containing chamber and a secondary fluid containing chamber, wherein said primary fluid chamber is primarily intended to contain fluids safe to touch (such as water) and said secondary chamber is primarily intended to contain other fluids (that may or may not be safe to touch). The fluid containing and dispersing apparatus features a collapsible and flexible nozzle with interchangeable fluid distribution heads, along with numerous internal and external chambers for carrying supplies, tools and equipment. Also features an easy to use pump apparatus with a fluid measuring display and a time recording feature. This design also features the secondary fluid containment chamber being used as a side handle to more efficiently use space as opposed to designs featured in the prior art.

AN EIGHTH EXAMPLE, U.S. Patent Office Document No. 20100163641, Published/Issued on Jul. 1, 2010, to Ugone teaches a fluid containing and dispersing apparatus comprising, a primary fluid containing chamber and a secondary mass containing chamber, wherein said primary fluid containing chamber is primarily intended to contain fluids (such as water) and said secondary chamber is primarily intended to contain other matter used as gardening supplements (fertilizers and the like) for plants. The instant invention provides user a means to avoid direct contact with such supplements, which is advantageous as these supplements often comprise chemicals. In one embodiment the invention features a substantially flexible nozzle with removable fluid distribution heads, external chambers for carrying supplies and equipment. Another embodiment comprises an easy to use pump with a fluid measuring display and a time recording feature. Another embodiment features a solid matter containment chamber without said pump apparatus. In the pump embodiment a secondary fluid containment chamber that is contiguously and seamlessly attached to said primary fluid containment chamber.

A NINTH EXAMPLE, U.S. Patent Office Document No. 20120085793, Published/Issued on Apr. 12, 2012, to Selina teaches the combination of molded plastic closure for an open top container and an extensible plastic spout adapted to be joined to the deck of the closure in either of two ways. In one way, the spout is molded with a U-shaped peripheral channel which receives a downwardly extending flange surrounding an aperture in the deck. In another way, the spout is pre-molded and then used as an insert when molding the closure.

It is apparent now that numerous innovations for multi-use containers have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a COMBINATION CONTAINER AND FUNNEL HAVING FLEXIBLE POURING SPOUT that avoids the disadvantages of the prior art.

ANOTHER OBJECT of the present invention is to provide a COMBINATION CONTAINER AND FUNNEL HAVING FLEXIBLE POURING SPOUT that is simple and inexpensive to manufacture.

STILL ANOTHER OBJECT of the present invention is to provide a COMBINATION CONTAINER AND FUNNEL HAVING FLEXIBLE POURING SPOUT that is simple to use.

BRIEFLY STATED, STILL YET ANOTHER OBJECT of the present invention is to provide a COMBINATION CONTAINER AND FUNNEL HAVING FLEXIBLE POURING SPOUT that can provide an adjustable funnel which is closable on both ends.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 2 is a diagrammatic side elevational view illustrating the COMBINATION CONTAINER AND FUNNEL HAVING FLEXIBLE POURING SPOUT showing the container being cut, and with the cap separated there from;

FIG. 4 is a diagrammatic side elevational view illustrating the COMBINATION CONTAINER AND FUNNEL HAVING FLEXIBLE POURING SPOUT showing the container with a ring of material being removed there from;

A MARSHALING OF REFERENCE NUMERALS UTILIZED IN THE DRAWING

Figure 1:
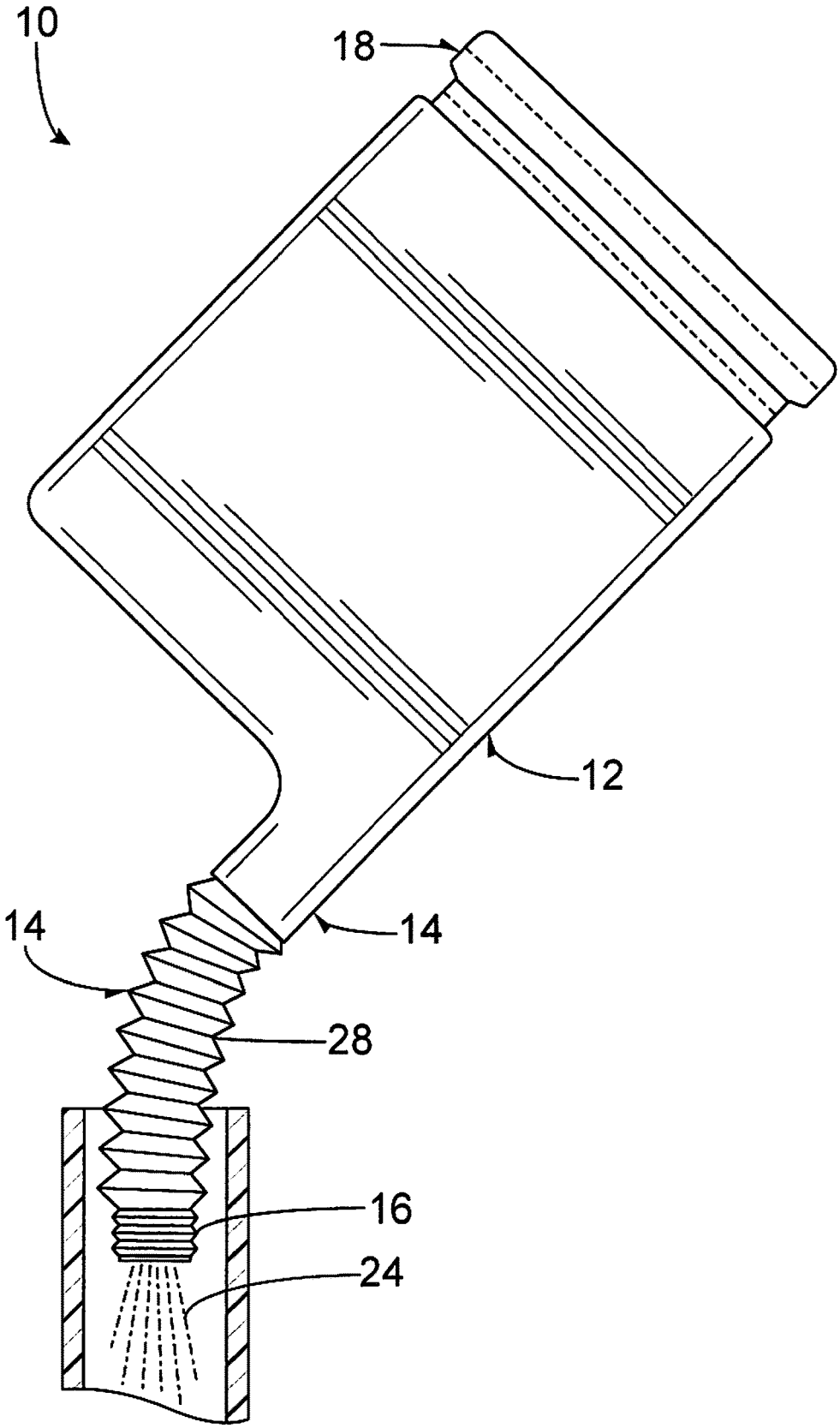
FIG. 1 is a diagrammatic side elevational view illustrating the COMBINATION CONTAINER AND FUNNEL HAVING FLEXIBLE POURING SPOUT in use before cutting off the bottom of the container.

10 device for acting as both a container and a funnel
12 body
14 neck
16 spout
18 base
20 proximal end of neck 14
22 distal end of neck 14
24 fluid
26 flexible portion of neck 14
28 accordion construction of flexible portion 26 of neck 14
30 cap
32 indented portion of base 18
34 flush portion of base 18

36 circumference of body 12
38 circumference of indented portion 32 of base 18
40 circumference of flush portion 34 of base 18
44 upper guide
46 lower guide
48 bottom portion of base 18
50 central portion of base 18
52 sidewall portion of bottom portion 48 of base 18
54 interior size of sidewall portion 52 of bottom portion 48 of base 18
56 thickness of sidewall portion 52 of bottom portion 48 of base 18

DETAILED DESCRIPTION OF THE PREFERRED EMBODIMENT

Referring now to the figures, in which like numerals indicate like parts, and particularly to FIG. 1, disclosed is a device 10 for acting as both a container and a funnel which has:

a) a body 12;
b) a neck 14;
c) a spout 16; and
d) a base 18.

The neck 14 has a proximal end 20 and a distal end 22. The proximal end 20 of the neck 14 is connected to the body 12. The spout 16 is disposed at the distal end 22 of the neck 14. The body 12 and the base 18 are for holding a fluid 24 to be dispensed through the spout 16 via the neck 14. The base 18 is for being at least partially detached from the body 12 after the dispensing of the fluid 24 through the spout 16 via the neck 14, so that the body 12, the neck 14, and the spout 16 may act as a funnel.

This structure is advantageous in particular because the use of the same container for pouring its own contents and then funneling other fluids can assist a user in assuring that the device 10 will act in a predictable manner in terms of positioning and tipping. For instance if the device 10 originally contained a fluid 24 of motor oil, and is then utilized as a funnel for more motor oil from other containers a user can anticipate that the subsequent oil will behave in a similar manner to the originally dispensed fluid 24. This is a common use case, as motor oil is often sold in 1 quart containers, and typically 4 or 5 such containers would be used for one vehicle oil change. But of course this use case is one example only.

Figure 5:
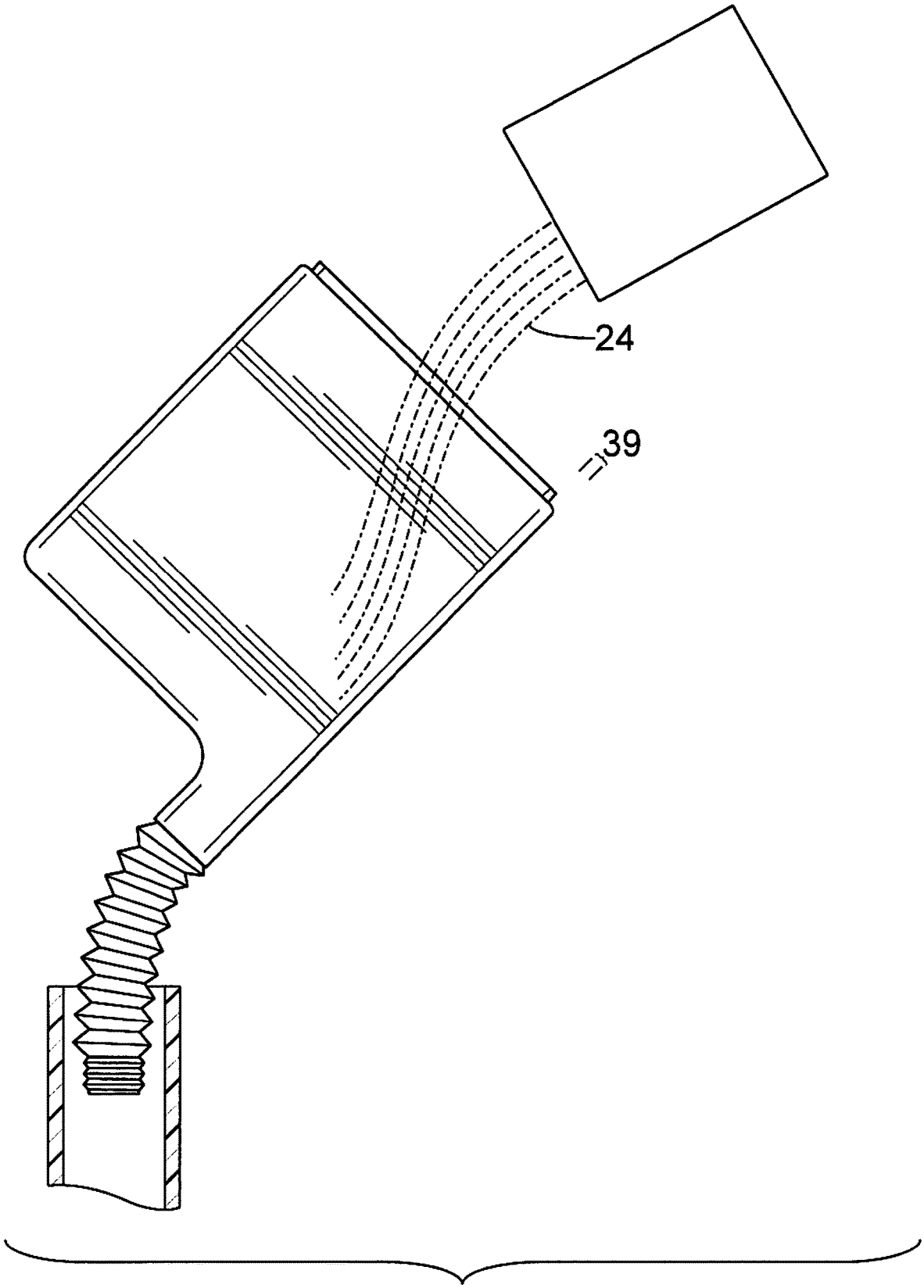
FIG. 5 is a diagrammatic side elevational view illustrating the COMBINATION CONTAINER AND FUNNEL HAVING FLEXIBLE POURING SPOUT in use as a funnel.

In the preferred construction, the neck 14 has a flexible portion 26. The flexible portion 26 of the neck 14 is flexible by virtue of having an accordion construction 28. Further in the preferred construction, the device 10 has a cap 30, which is threadably attachable to the spout 16. To facilitate this, the spout 16 is rigid. This construction allows the dispensing of the initial fluid 24 and funneling of subsequent fluids 24 to be done at a larger variety of angles as illustrated in FIGS. 1 and 5.

Figure 3:
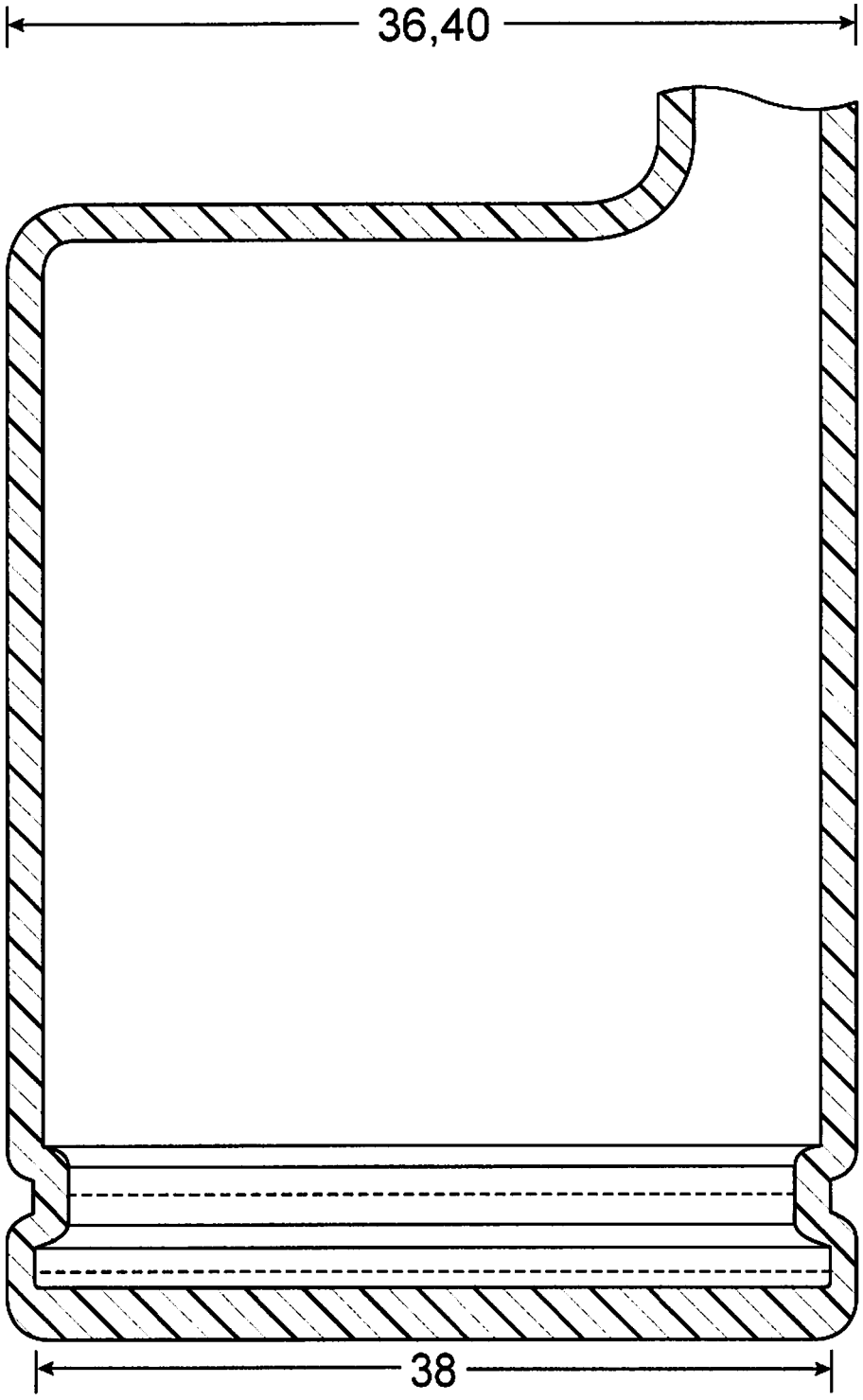
FIG. 3 is a partial cross sectional view of the container before cutting.

To facilitate the removability of the base 18, the base 18 has an indented portion 32 and a flush portion 34. Further, the body has a circumference 36. The indented portion 32 has a circumference 38 which is recessed from the circumference 36 of the body 12 by a distance 39. The flush portion 34 has a circumference 40 substantially identical to the circumference 36 of the body 12. This is best illustrated in FIGS. 3 and 5.

It is to be understood that the use of the term "circumference" here refers to the outer dimensions of the parts described and does not limit them to any particular shape, as possible shapes could include a cylindrical shape, as well as the substantially rectangular shape depicted in the figures.

Further to facilitate the removability of the base 18, the base 18 has at least two guides, which include an upper guide 44 and a lower guide 46. The guides are for guiding a user in cutting of the device 10. The upper guide 44 is on the indented portion 32 of the base 18. The lower guide 46 is on the flush portion 34 of the base 18.

Figure 2:
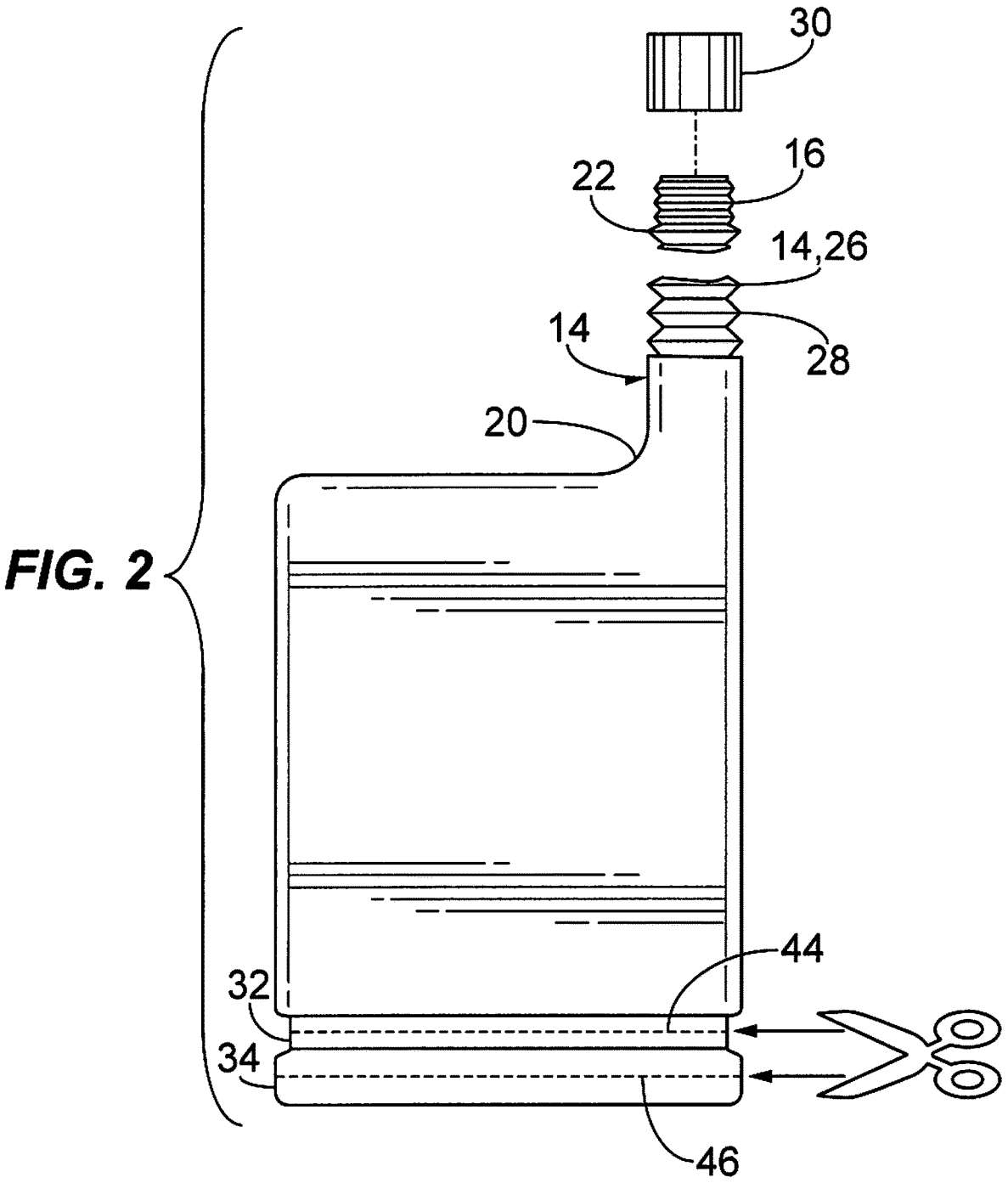
Figure 4:
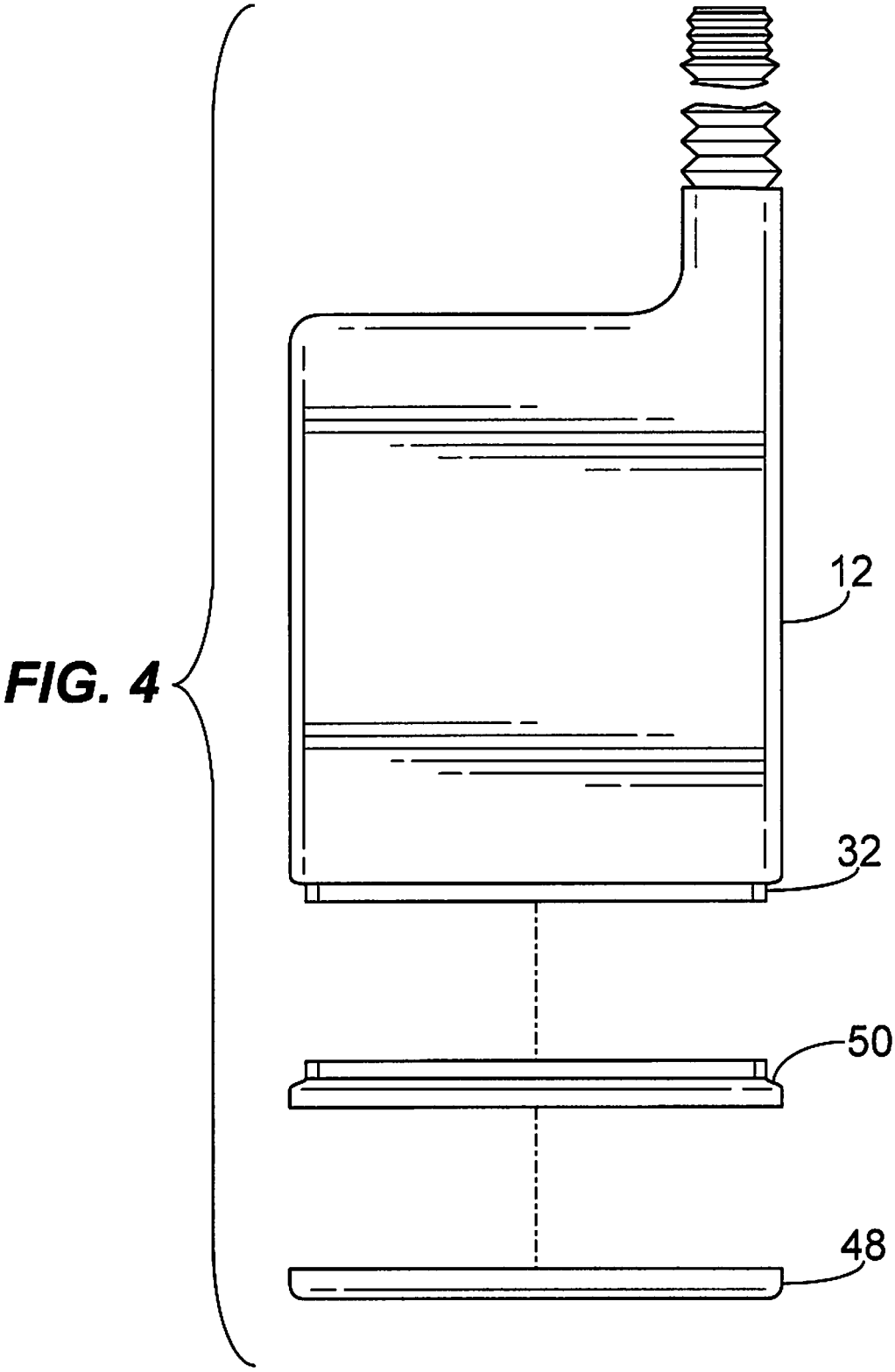
Figure 6:
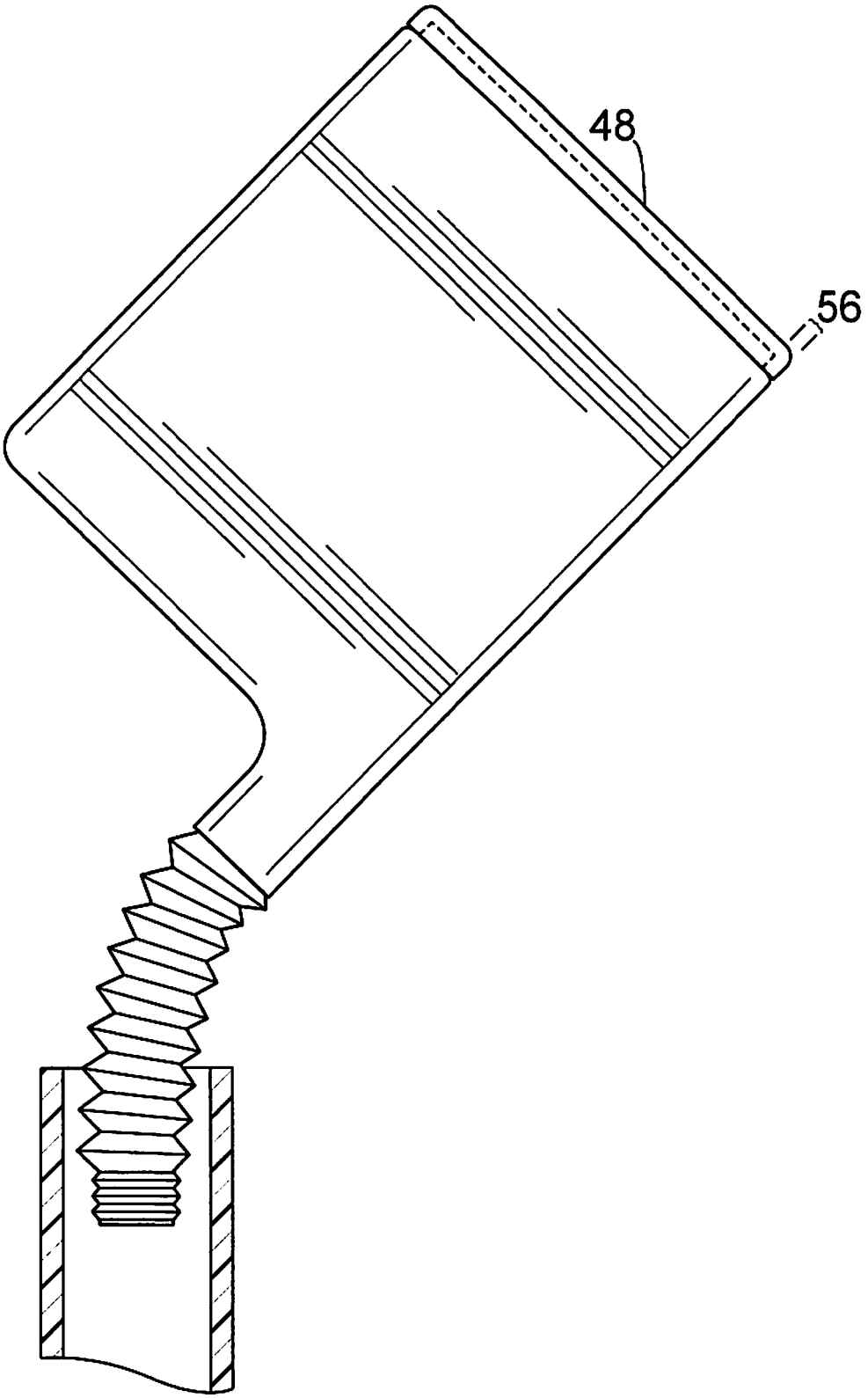
FIG. 6 is a diagrammatic side elevational view illustrating the COMBINATION CONTAINER AND FUNNEL HAVING FLEXIBLE POURING SPOUT showing the severed bottom being replaced on the open funnel end.
Figure 7:
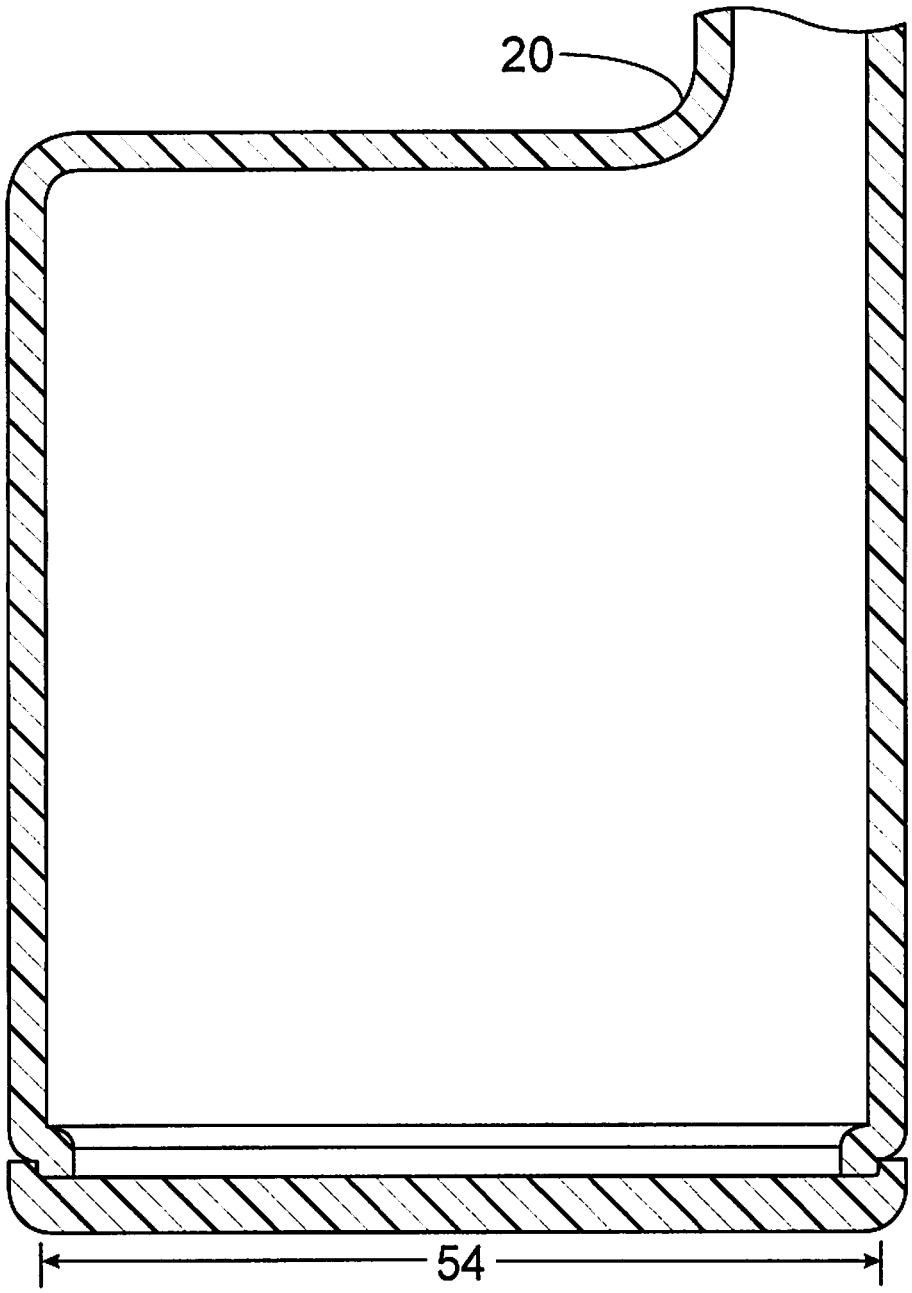
FIG. 7 is a partial cross sectional view of the container showing the severed bottom being replaced on the open funnel end.

When a user cuts along the upper guide 44 of the base 18 and the lower guide 46 of the base 18, a bottom portion 48 and a central portion 50 are separated from the base 18. This is illustrated in FIGS. 2 and 4. The bottom portion 52 of the base 18 has a sidewall portion 52, which sidewall portion 52 has an interior size 54. The interior size 54 of the sidewall portion 52 of the bottom portion 48 of the base 18 corresponds to the circumference 38 of the indented portion 32 of the base 18. This construction allows the bottom portion 48 to act as a cap for the device 10 after it has been used as a funnel, as illustrated in FIGS. 4, 6, and 7. The correspondence in size of the interior size 54 of the sidewall portion 52 with the circumference 38 of the indented portion 32 allows it to be snugly fit thereon.

In the preferred construction, the sidewall portion 52 of the bottom portion 48 of the base has a thickness 56. The thickness of the sidewall portion 52 of the bottom portion 48 of the base 18 corresponds to the distance by which the circumference 38 of the indented portion 32 of the base 18 is recessed from the circumference 36 of the body 12.

This construction is most clearly illustrated in FIG. 7. This is advantageous in that it allows the bottom portion 48 to fit sleekly with the body 12 for both aesthetic and storage reasons, as well as for ease of construction of the device, because it allows for a thinner material to be used with a smaller indent, and a thicker material to be used with a larger indent. And because the size of the indent will impact the structural integrity of the device 10, this allows for good structural integrity in a large variety of materials and thicknesses thereof.

It will be understood that each of the elements described above, or two or more together, may also find a useful application in other types of constructions differing from the types described above.

While the invention has been illustrated and described as embodiments of a COMBINATION CONTAINER AND FUNNEL HAVING FLEXIBLE POURING SPOUT, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for acting as both a container and a funnel which comprises:

a) a body;
b) a neck;
c) a spout; and
d) a base;

wherein said neck has a proximal end and a distal end;

wherein said proximal end of said neck is connected to said body;

wherein said spout is disposed at said distal end of said neck;

wherein said body and said base are for holding a fluid to be dispensed through said spout via said neck; and wherein said base is for being at least partially detached from said body after said dispensing of said fluid through said spout via said neck, so that said body, said neck, and said spout may act as a funnel;

wherein said neck comprises a flexible portion;

wherein said flexible portion of said neck is flexible by virtue of having an accordion construction;

wherein said device further comprises a cap;

wherein said cap is threadably attachable to said spout;

wherein said spout is rigid;

wherein said base comprises an indented portion and a flush portion;

wherein said body has a circumference;

wherein said indented portion has a circumference which is recessed from said circumference of said body by a distance;

wherein said flush portion has a circumference substantially identical to said circumference of said body;

wherein said base further comprises at least two guides;

wherein said at least two guides comprise an upper guide and a lower guide;

wherein said guides are for guiding a user in cutting of said device;

wherein said upper guide is on said indented portion of said base;

wherein said lower guide is on said flush portion of said base;

wherein when a user cuts along said upper guide of said base and said lower guide of said base, a bottom portion and a central portion are separated from said base;

wherein said bottom portion of said base has a sidewall portion;

wherein said sidewall portion has an interior size;

wherein said interior size of said sidewall portion of said bottom portion of said base corresponds to said circumference of said indented portion of said base;

wherein said sidewall portion of said bottom portion of said base has a cross-sectional thickness; and wherein said cross-sectional thickness of said sidewall portion of said bottom portion of said base is substantially identical in measure to said distance by which said circumference of said indented portion of said base is recessed from said circumference of said body.

2. The device of claim 1 wherein said upper guide is centered on said indented portion of said base; and wherein said lower guide is centered on said flush portion of said base.

* * * * *